US006719417B2

(12) United States Patent
Hay et al.

(10) Patent No.: US 6,719,417 B2
(45) Date of Patent: Apr. 13, 2004

(54) INK CONTAINER ASSEMBLY

(75) Inventors: Mark A. Hay, Poway, CA (US); Andrew Smith, San Diego, CA (US); David Berardelli, San Diego, CA (US); Raul Perez, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/208,697

(22) Filed: Jul. 30, 2002

(65) Prior Publication Data

US 2004/0021748 A1 Feb. 5, 2004

(51) Int. Cl.[7] ..... B41J 2/175
(52) U.S. Cl. ..... 347/86
(58) Field of Search ..... 347/85–87

(56) References Cited

U.S. PATENT DOCUMENTS 5,221,935 A * 6/1993 Uzita ..... 347/36
5,896,151 A * 4/1999 Miyazawa et al. ..... 347/86
6,227,661 B1 * 5/2001 Hayakawa ..... 347/86
2002/0089576 A1 * 7/2002 Ishizawa et al. ..... 347/86

FOREIGN PATENT DOCUMENTS

JP 11157098 A1 * 6/1999 ..... 347/86

* cited by examiner

*Primary Examiner*—Stephen D. Meier
*Assistant Examiner*—An H. Do

(57) ABSTRACT

A recyclable ink container, ink container base assembly, and a method of attaching an ink container to a recyclable ink container base are disclosed. The container and ink container base assembly may be formed of recyclable material. A locking nut and needle assembly are part of the base fixture that hold the ink container assembly in place. The needle assembly is independent of the locking nut such that the ink needle and airline properly align when the locking nut is turned.

11 Claims, 5 Drawing Sheets

INK CONTAINER ASSEMBLY

FIELD OF THE INVENTION

The present invention relates to Ink Container Assemblies, and more particularly to recyclable ink containers

BACKGROUND OF THE INVENTION

There is a continuing need for low cost ways to package and ship ink to customers for printing systems and applications.

SUMMARY OF THE INVENTION

In one embodiment of the present invention, a recyclable ink container is provided, comprising: an ink bag; a bag cap attached to an opening in the ink bag, the bag cap including a mating surface to mate with a surface of a base, the bag cap including an ink aperture to receive an ink withdrawal device and an air aperture to receive an air input device; and a shell including a side portion substantially perpendicular to the mating surface with at least one projection that extends substantially perpendicular from the side portion at only a section of a perimeter of the side surface.

In a further embodiment of the present invention, a recyclable ink container is provided, comprising: an ink bag; a bag cap attached to an opening in the ink bag, the bag cap including a mating surface to mate with a surface of a base, the bag cap including an ink aperture to receive an ink withdrawal device and an air aperture to receive an air input device; and a shell including a side portion substantially perpendicular to the mating surface with at least one slot therein that runs substantially perpendicular to the mating surface so as to allow a projection from a locking nut to move along this slot as the mating surface for the bag cap approaches and mates with the mating surface for the base, and having a lock region in the shell substantially perpendicular to and communicating with the slot to allow the locking nut to be at least partially rotated so that the projection is moved from the slot into the lock region to lock the ink container in place.

In a yet further embodiment of the present invention, an ink container base assembly is provided, comprising: a base with a mating surface; an ink needle and an air needle aligned in parallel and projecting from the mating surface of the base; an at least partially rotatable locking nut moveably attached to the base and positioned to receive a shell of an ink container.

In a yet further embodiment of the present invention, an ink container base assembly is provided, comprising: a base with a mating surface; an ink needle and an air needle aligned in parallel and projecting from the mating surface of the base; an at least partially rotatable locking nut moveably attached to the base and positioned to receive a shell of an ink container, an inner side surface perimeter of the locking nut being substantially perpendicular to the mating surface of the base and having at least one projection that extends substantially perpendicular from the inner side surface perimeter but extends for only a section of the inner side surface perimeter.

In a further embodiment of the present invention, a method is provided for mating a recyclable ink container to an ink container base assembly having a base and an attached locking nut that is at least partially rotatable, comprising: aligning an ink aperture in the ink container to receive an ink withdrawal device projecting from the ink container base assembly and aligning an air aperture in the ink container to receive an air input device projecting from the ink container base assembly, and also aligning at least one projection that extends substantially perpendicular from a side portion of the ink container with a slot in the locking nut on the ink container base assembly, the slot running substantially perpendicular to a mating surface of the base assembly so as to allow the projection to move along the slot as the mating surface for the ink container approaches and mates with the mating surface for the base; mating the ink aperture in the ink container to the ink withdrawal device projecting from the ink container base assembly and mating the air aperture to receive the air input device projecting from the ink container base assembly, and also inserting the projection to move along the slot until the mating surface of the ink container mates with the mating surface of the base assembly; and at least partially rotating the locking nut to lock the ink container to the base assembly.

DETAILED DESCRIPTION OF THE EMBODIMENTS OF THE INVENTION

Figure 1:
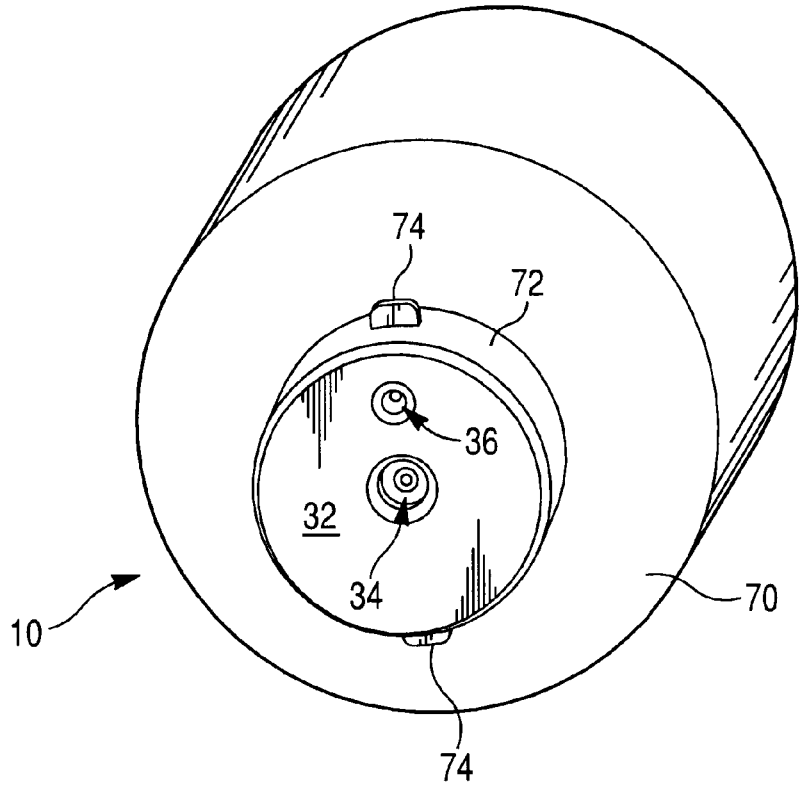
FIG. 1 is a schematic diagram of an embodiment of the ink container of the present invention.
Figure 2:
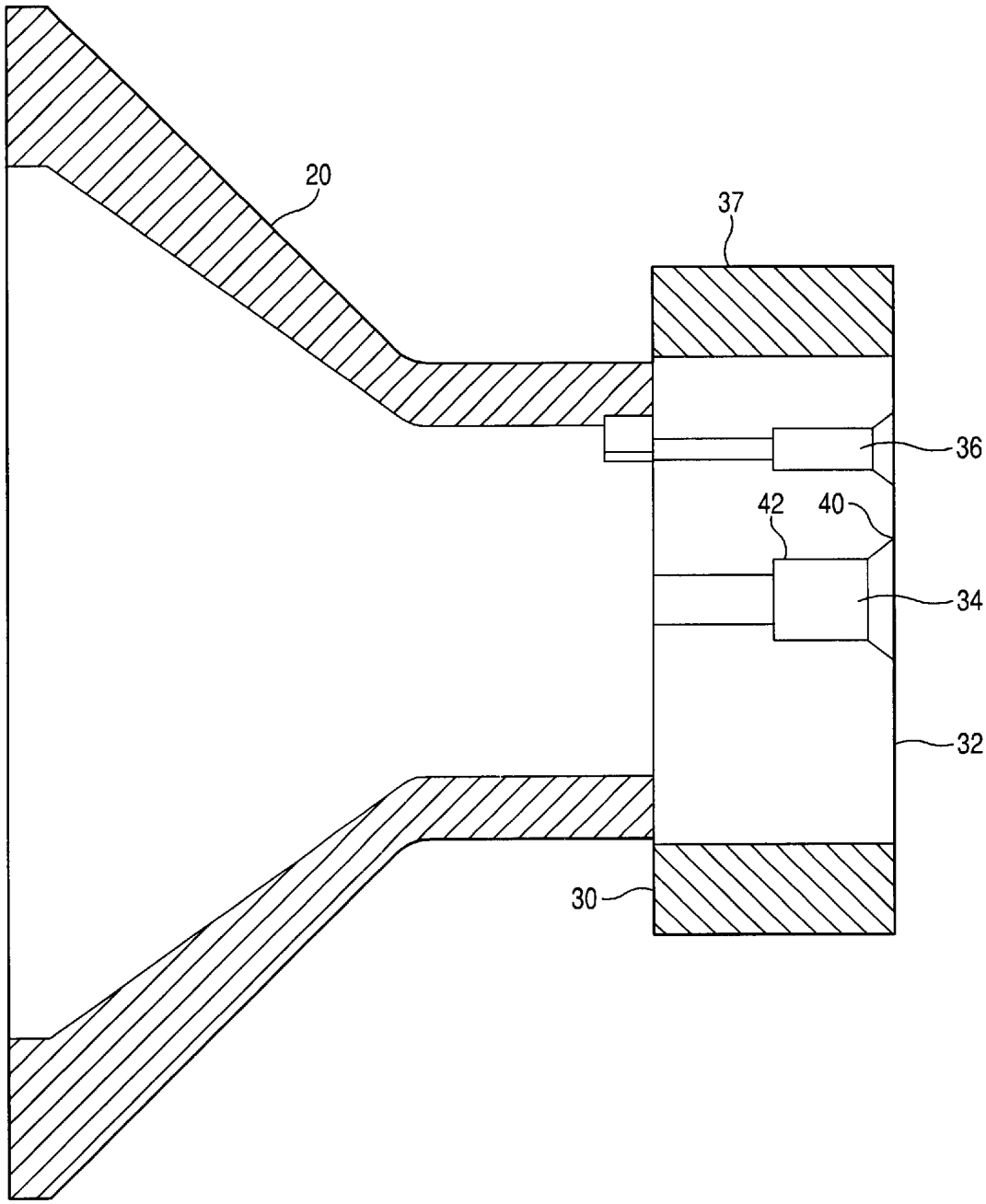
FIG. 2 is a schematic diagram of an internal construction of one embodiment of the ink container in accordance with the present invention.

FIGS. 1 and 2 are schematic diagrams of a recyclable ink container 10 in accordance with one embodiment of the present invention. The recyclable ink container 10 comprises an ink bag 20, and a bag cap 30 which is attached to an opening in the ink bag 20. The bag cap 30 includes a mating surface 32 to mate with a surface of a base to be described below. The mating surface 32 may take any convenient configuration. The bag cap 30 includes an ink aperture 34 to receive an ink withdrawal device from the base, and an air aperture 36 to receive an air input device from the base. The bag cap 30 further includes side surfaces 37 (shown in FIG. 2) substantially perpendicular to the mating surface 32. A hard or semi-hard shell 70 encloses the bag 20 and has a side portion 72 disposed around the side surfaces 37 of the bag cap 30 using a compression fit or other convenient method of attachment. The shell 70 includes at least one projection 74 that extends substantially perpendicular from the side portion of the shell at only a section of a perimeter of the side portion 72. In the embodiment shown in FIG. 1, two projections 74 are illustrated.

In one embodiment of the present invention, at least one of the apertures 34 and 36 in the bag cap 30 has a first circumference 40 at the mating surface 32, and a second smaller circumference 42 below the mating surface 32. In the embodiment shown in FIG. 1, the aperture with the first circumference 40 and the second circumference 42 is the ink aperture 44. One purpose of using two different circumferences is to allow a tapering of the aperture 34 for ease of insertion of the ink withdrawal device. In one embodiment of the invention, at least one of the apertures 34 and 36 in the bag cap 30 has a circumference that tapers from a first circumference at the mating surface to a second smaller circumference below the mating surface.

Figure 3:
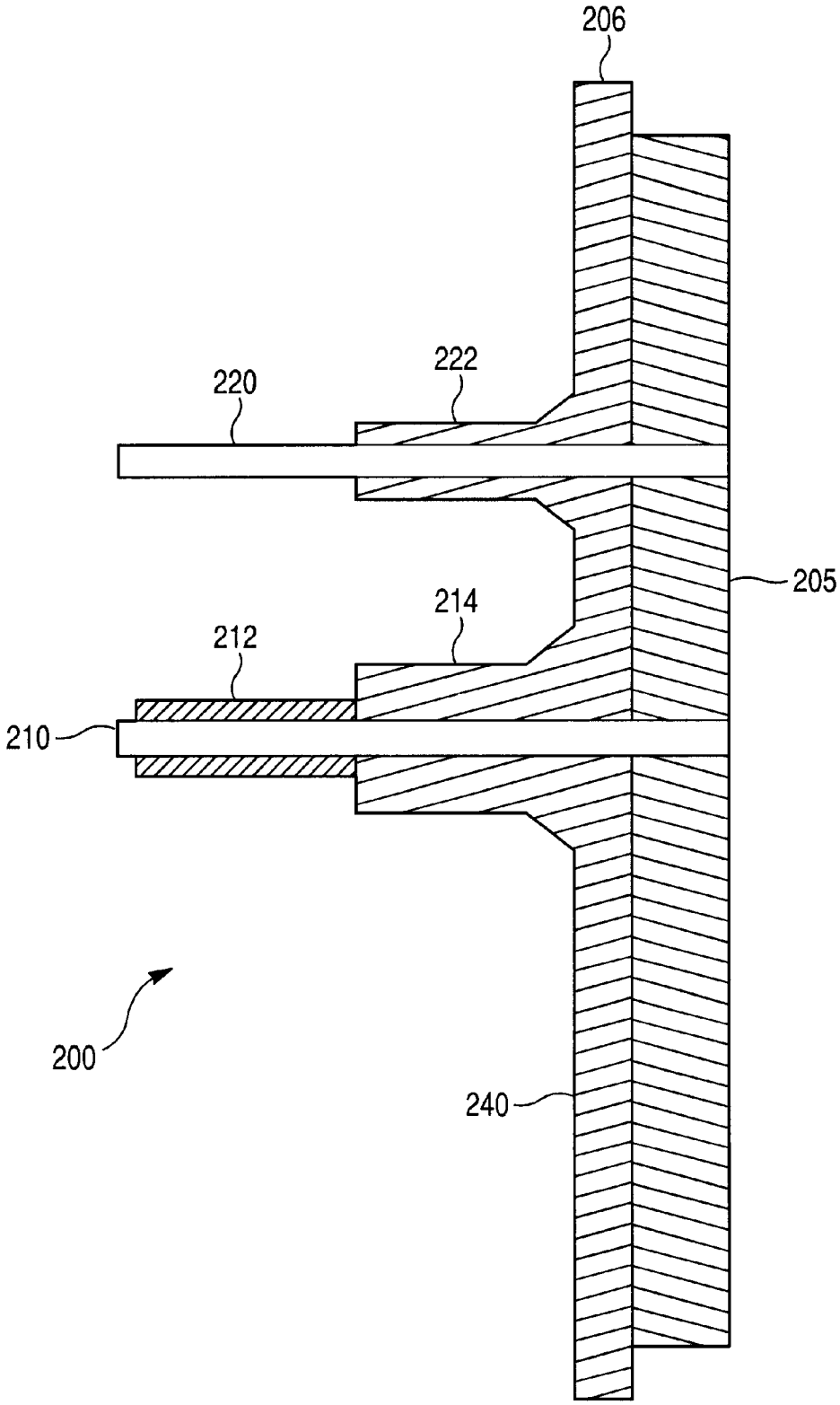
FIG. 3 is a schematic diagram of one embodiment of a base in accordance with the present invention.

Referring now to FIG. 3, there is shown a base 200 for mounting a recyclable ink container. The base 200 includes a base portion 205, a lip portion 206 extending out from the periphery of the base portion 205, an ink needle 210, and an air needle 220. The ink needle 210 extends from a projection 214 disposed on a mating surface 240 of the base 200 and may include a gasket 212 therearound for protection of the needle. The air needle 220 likewise extends from a projection 222 from the mating surface 240 of the base 200. The ink needle 210 and the air needle 220 are aligned in parallel.

Figure 4:
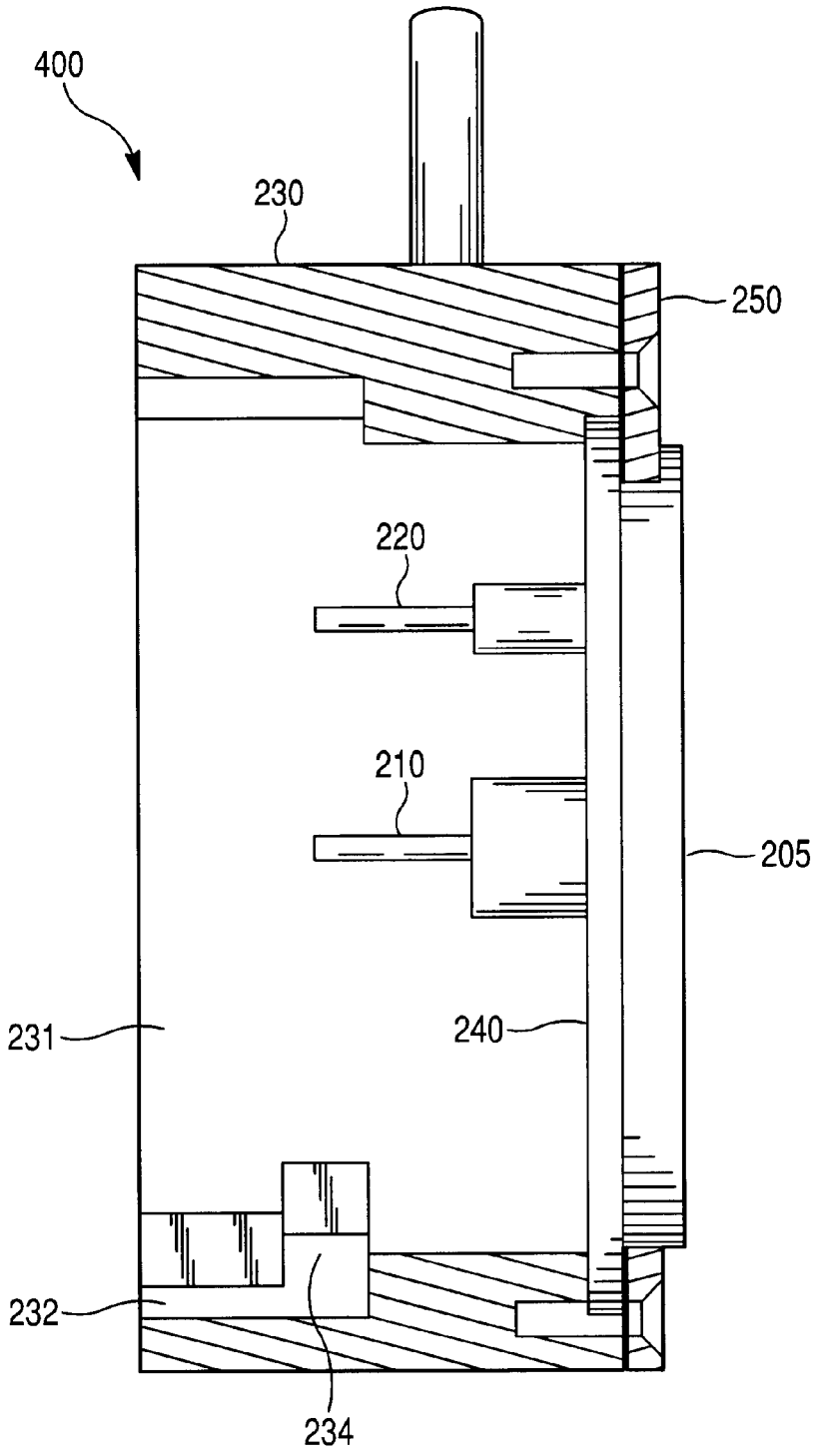
FIG. 4 is a schematic diagram of one embodiment of a base assembly including a base and a locking nut assembly in accordance with the present invention.

Referring to FIG. 4, a base assembly 400 is shown that has at least a partially rotatable locking nut 230 that may be movably attached to the base 200 and positioned to receive an ink container bag cap with at least one lateral projection that extends from the side portion of the shell 70 and that is perpendicular to a bag cap mating surface of the bag cap but does not extend around an entire perimeter of the side portion of the shell. The locking nut 230 has an inner perimeter 231 that has at least one slot 232 therein that runs substantially perpendicular to the mating surface 240 of the base so as to allow the projection from the side portion of the shell to move along this slot as the mating surface for the bag cap approaches and mates with the mating surface 240 for the base. The locking nut 230 further includes a lock region 234 in the locking nut inner perimeter 231 that is substantially perpendicular to and communicates with the slot 232 to allow the locking nut to be partially rotated so that the projection is moved from the slot 232 into the lock region 234 to hold the bag cap in place.

The locking nut 230 is attached using any convenient attachment method to the base 200, so that it is at least partially rotatable. In one embodiment, this attachment is accomplished by including a closure piece 250 attached by screws or other convenient attachment method to the locking nut 230 so as to trap the lip portion 206 of the base 200 therebetween, but having a small clearance to allow the locking nut 230 to be at least partially rotatable.

Figure 5:
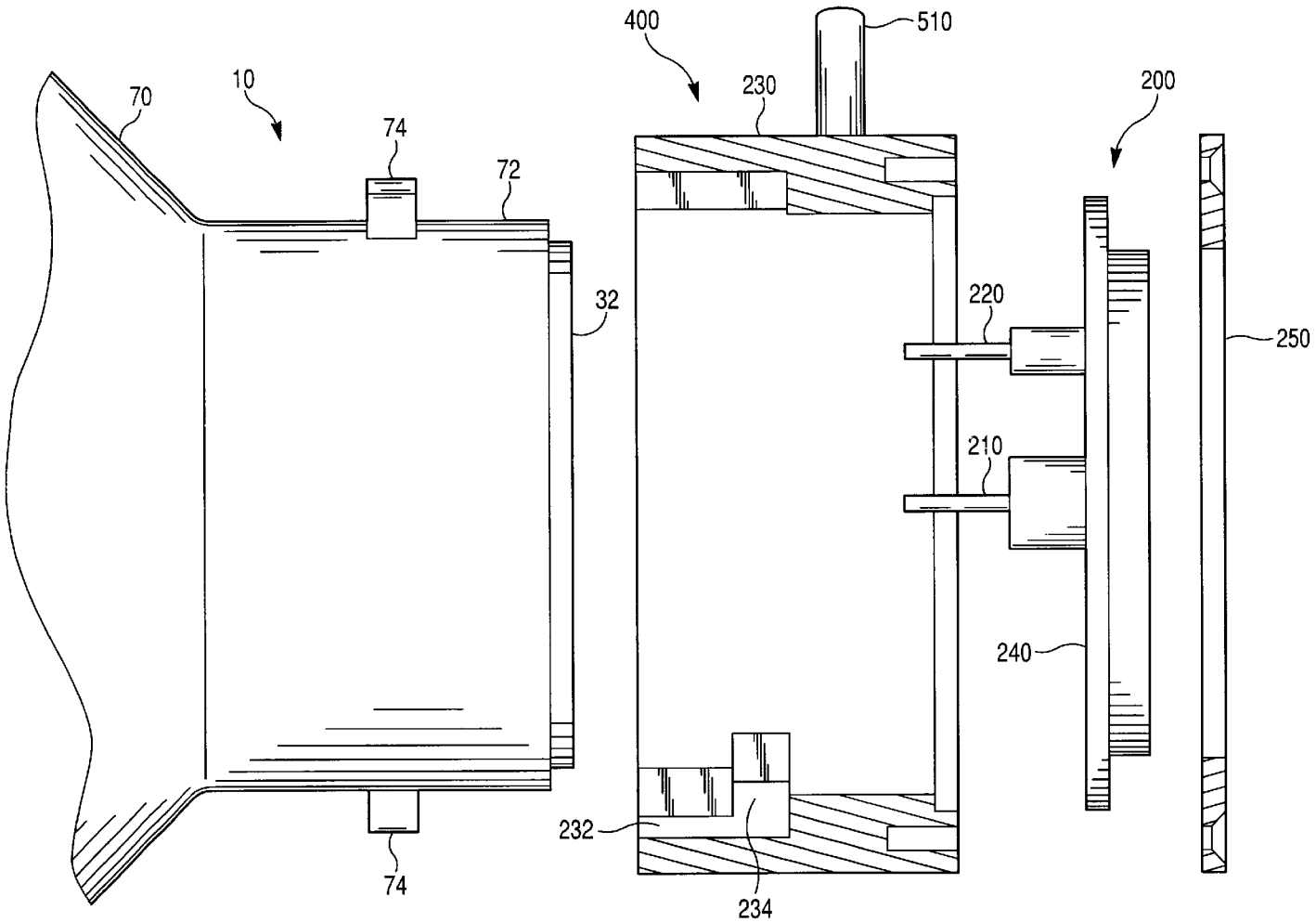
FIG. 5 is an exploded schematic view of one embodiment of an ink container, locking nut assembly and base in accordance with the present invention.

FIG. 5 illustrates an exploded view the recyclable ink container 10 (with only the side 240 of the mating surface of the bag cap shown), the and base assembly 400 with the locking nut 230 shown separated from the base 200 and the closure piece 250. In one embodiment of the invention, a handle 510 may be provided on the locking nut 230 in order to facilitate a rotation motion of the locking nut.

In one embodiment of the invention, the shell 70 of the recyclable ink container 10 may be made of recyclable material such as a plastic. The mating of the recyclable ink container 10 on the ink container base assembly 400 comprises the steps of lining up the apertures 34 and 36 in the bag cap 30 with the ink needle 210 and the air needle 220 on the base 200, as well as lining up the projections 74 on the on the side portion 72 of the shell 70 with the slots 232 in the locking nut 230. The recyclable ink container 10, once properly aligned, would be inserted onto the base 200 so that the mating surface 32 of the bag cap 30 mates with the mating surface 240 of the base assembly 200. Finally, the locking nut would be partially rotated to hold or lock the recyclable ink container 10 in place.

Note that the term "slot" is intended to be a generic term that includes not only slots but also grooves and other types of indents that would allow a projection to move thereon.

If a customer is using a pressurized ink supply system to feed ink to a pen, then in one embodiment would push air through the air needle 220 into the ink bag 20. A chamber (not shown) in the bag cap 30 facilitates pushing ink through the ink needle 210 to a pen manifold to supply any number of pens. Alternatively, if a customer is using gravity to feed ink pens, then the recyclable ink container may be placed above the ink pen and an airline from the air needle 220 opened to the atmosphere.

Selected embodiments of the present invention-provide customers the flexibility to use the recyclable ink container system with a pump or gravity feed to supply ink to pens. The present invention may be designed in embodiments which are easy to handle and hold more ink than many current ink containers. The recyclable ink container for the present invention is particularly useful for jurisdictions that require recycling. The present recyclable ink container may be designed in a variety of different sizes to fill various customer applications and needs. Accordingly, embodiments of the present invention may provide a low cost way to package and ship ink to customers in volume. Selected embodiments of the invention will allow customers to use large amounts of ink with less down time and/or less intervention due to requirements of changing containers. Embodiments of the present invention provide an inexpensive and easy way to ship bulk ink in one half to one gallon containers, for example. Some configurations of the present invention allow substantial recycling of most parts of the ink delivery system with the only disposable part of the assembly being the ink bag.

It should be noted that the slot and projection relationship between the shell and the locking nut could be reversed. In such a reversed design, the shell would include a side portion substantially perpendicular to the mating surface with at least one slot therein that runs substantially perpendicular to the mating surface so as to allow a projection from the locking nut to move along this slot as the mating surface for the bag cap approaches and mates with the mating surface for the base, and having a lock region in the shell substantially perpendicular to and communicating with the slot to allow the locking nut to be partially rotated so that the projection is moved from the slot into the lock region to lock the bag cap in place. Likewise, in this reversed design the partially rotatable locking nut would include an inner side surface perimeter of the locking nut that is substantially perpendicular to the mating surface of the base and that has at least one projection that extends substantially perpendicular from the inner side surface perimeter but extends for only a portion of the inner side surface perimeter.

The foregoing description of embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A recyclable ink container, comprising:

an ink bag;

a bag cap attached to an opening in the ink bag, the bag cap including a mating surface to mate with a surface of a base, the bag cap including an ink aperture to receive an ink withdrawal device and an air aperture to receive an air input device; and a shell including a side portion substantially perpendicular to the mating surface with at least one projection that extends substantially perpendicular from the side portion at only a section of a perimeter of the side surface.

2. The ink container as defined in claim 1, wherein at least one of the apertures in the bag cap has a first circumference at the mating surface and a second smaller circumference below the mating surface.

3. The ink container as defined in claim 1, wherein the at least one of the apertures in the bag cap has a circumference that tapers from a first circumference at the mating surface to a second smaller circumference below the mating surface.

4. The ink container as defined in claim 1, wherein there are at least two projections from the side portion of the shell.

5. A recyclable ink container, comprising:

an ink bag;

a bag cap attached to an opening in the ink bag, the bag cap including a mating surface to mate with a surface of a base, the bag cap including an ink aperture to receive an ink withdrawal device and an air aperture to receive an air input device; and a shell including a side portion substantially perpendicular to the mating surface with at least one slot therein that runs substantially perpendicular to the mating surface so as to allow a projection from a locking nut to move along this slot as the mating surface for the bag cap approaches and mates with the mating surface for the base, and having a lock region in the shell substantially perpendicular to and communicating with the slot to allow the locking nut to be at least partially rotated so that the projection is moved from the slot into the lock region to lock the ink container in place.

6. An ink container base assembly, comprising:

a base with a mating surface;

an ink needle and an air needle aligned in parallel and projecting from the mating surface of the base; and an at least partially rotatable locking nut moveably attached to the base and positioned to receive a shell of an ink container.

7. The ink container base assembly as defined in claim 6, wherein the ink container has at least one lateral projection that extends from a side portion that is perpendicular to a mating surface of a bag cap on the ink container but does not extend around an entire perimeter of the side portion of the shell, and wherein the locking nut has an inner perimeter that has at least one slot therein that runs substantially perpendicular to the mating surface of the base so as to allow the projection from the shell to move along this slot as the mating surface for the bag cap approaches and mates with the mating surface for the base, and having a lock region in the locking nut substantially perpendicular to and communicating with the slot to allow the locking nut to be partially rotated so that the projection is moved from the slot into the lock region to lock the bag cap in place.

8. The ink container base assembly as defined in claim 6, wherein the base includes a lip portion around the periphery of the base, and further comprising a closure piece attached to the locking nut to trap the lip portion therebetween in a manner that allows the locking nut to be at least partially rotatable.

9. An ink container base assembly, comprising:

a base with a mating surface;

an ink needle and an air needle aligned in parallel and projecting from the mating surface of the base; and an at least partially rotatable locking nut moveably attached to the base and positioned to receive a shell of an ink container, an inner side surface perimeter of the locking nut being substantially perpendicular to the mating surface of the base and having at least one projection that extends substantially perpendicular from the inner side surface perimeter but extends for only a section of the inner side surface perimeter.

10. The ink container base assembly as defined in claim 9, wherein the base includes a lip portion around the periphery of the base, and further comprising a closure piece attached to the locking nut to trap the lip portion therebetween in a manner that allows the locking nut to be at least partially rotatable.

11. A method for mating a recyclable ink container to an ink container base assembly having a base and an attached locking nut that is at least partially rotatable, comprising:

aligning an ink aperture in the ink container to receive an ink withdrawal device projecting from the ink container base assembly and aligning an air aperture in the ink container to receive an air input device projecting from the ink container base assembly, and also aligning at least one projection that extends substantially perpendicular from a side portion of the ink container with a slot in the locking nut on the ink container base assembly, the slot running substantially perpendicular to a mating surface of the base assembly so as to allow the projection to move along the slot as the mating surface for the ink container approaches and mates with the mating surface for the base;

mating the ink aperture in the ink container to the ink withdrawal device projecting from the ink container base assembly and mating the air aperture to receive the air input device projecting from the ink container base assembly, and also inserting the projection to move along the slot until the mating surface of the ink container mates with the mating surface of the base assembly; and at least partially rotating the locking nut to lock the ink container to the base assembly.

* * * * *